US005671469A

United States Patent [19]

Yasuda

[11] Patent Number: 5,671,469

[45] Date of Patent: Sep. 23, 1997

[54] IMAGE RECORDING APPARATUS

[75] Inventor: Keisuke Yasuda, Kanagawa, Japan

[73] Assignee: Fuji Photo Film Co., Ltd., Kanagawa, Japan

[21] Appl. No.: 673,360

[22] Filed: Jun. 28, 1996

[30] Foreign Application Priority Data

Jun. 30, 1995 [JP] Japan ..... 7-165996

[51] Int. Cl.[6] ..... G03G 21/00

[52] U.S. Cl. ..... 399/197; 399/196

[58] Field of Search ..... 399/190, 196, 399/197, 201, 202

[56] References Cited

U.S. PATENT DOCUMENTS

| | | | |
|---|---|---|---|
| 4,648,703 | 3/1987 | Brugman . | |
| 4,941,017 | 7/1990 | Mishima et al. | 355/218 |
| 4,963,931 | 10/1990 | Jong et al. | 355/218 |
| 5,068,687 | 11/1991 | Kamimura et al. | 355/45 |

*Primary Examiner*—R. L. Moses

*Attorney, Agent, or Firm*—Sughrue, Mion, Zinn, Macpeak & Seas, PLLC

[57] ABSTRACT

An image recording apparatus which exposes a document image to a photosensitive material to obtain a reproduced image, comprising: first magnification setting means which automatically sets a first exposure magnification in which the document image is recorded on the overall surface of the photosensitive material; second magnification setting means which changes the first exposure magnification which has been set by the first magnification setting means to set a second exposure magnification where the first exposure magnification has been increased by a predetermined value so that margin is prevented from being formed at the periphery of an image which is recorded on the photosensitive material; and exposure means which exposes the document image to the photosensitive material, on the basis of the central portion of the document image, in one of the first exposure magnification which has been set by the first magnification setting means and the second exposure magnification which has been set by the second magnification setting means. As a result, when the photosensitive material is exposed in said second exposure magnification, the document image can be exposed to said photosensitive material in a larger size than that of said photosensitive material.

18 Claims, 5 Drawing Sheets

IMAGE RECORDING APPARATUS

BACKGROUND OF THE INVENTION

1. Field of the Invention

The present invention relates to an image recording apparatus and a method thereof to obtain a reproduced image by exposing a document or original image to a photosensitive material.

2. Description of the Related Art

Conventionally, an image recording apparatus is known which implements an image recording process by using two types of image recording materials such as a photosensitive material and an image receiving material.

In such an image recording apparatus, the photosensitive material and the image receiving material are accommodated in the form of a roll in the relevant magazines which are light-shielded. Each time an image recording process is performed, the materials are sequentially pulled out and used. The image recording apparatus is provided with a water application section capable of applying an image forming solvent to the photosensitive material, and a heat development/transfer section which comprises a heating drum and an endless pressure-contact belt which is pressed at the outer periphery of the heating drum and which rotates with the heating drum.

An image is exposed to the photosensitive material which has been pulled out from the magazine by a predetermined length and cut as being nipped and transported by transport rollers. After the photosensitive material has been applied by the water serving as an image forming solvent, the photosensitive material is fed into the heat development/transfer section. On the other hand, in the same way as the photosensitive material, the image receiving material which has been pulled out from the magazine by a predetermined length and cut is synchronized with the transporting of the photosensitive material by the transport rollers and fed into the heat development/transfer section. At the heat development/transfer section, the photosensitive material which has undergone the water application is superposed on the image receiving material. In this superposed state, both materials are tightly entrained around the outer periphery of the heating drum. Further, the photosensitive material is heat-developed while the photosensitive material and the image receiving material are nipped and transported by the heating drum and the endless pressure-contact belt, and the image is transferred to the image receiving material, so that a predetermined image can be formed (or recorded) on the image receiving material.

In the image recording apparatus described above, a reflecting or opaque document is positioned at a portion on the glass surface which is usually provided on the upper surface of the apparatus body. The image on the document is scanned by a line scanner, is exposed to the photosensitive material, and is transferred from the photosensitive material and recorded on the image receiving material.

However, when an image is recorded on or exposed to a photosensitive material in an equal magnification, a case might be taken place in which the widthwise and longitudinal sizes of the photosensitive material do not necessarily correspond to those of the image exposed to the photosensitive material. This is caused by the accuracy of the size of the photosensitive material, the accuracy of the positioning of the zoom lens for changing the magnification, and the variations of an optical path length (i.e., due to a deflection of the photosensitive material in the thickness direction thereof). In such a case, when the document or original image is recorded or exposed larger than an image recording area or the size of the photosensitive material on the photosensitive material, the appearance of the image which is recorded on or exposed to the photosensitive material does not become worse because no margin is formed at the periphery of the image recorded on the photosensitive material. On the contrary, when the document image is recorded smaller than the image recording area on the photosensitive material, margin is formed on the photosensitive material. In addition, in a case in which the accuracy of the positioning of the document, the accuracy of the transport positioning of the photosensitive material, and the accuracy of the position in which the document image exposed to the photosensitive material is transferred to the image receiving material are not good, margin is formed in a state in which it is enlarged or/and inclined, so that the appearance of the resultant image becomes worse.

Further, there might be a case in which margin having a predetermined margin width is intentionally provided at the periphery of a recorded image, which is so-called "image with margin". However, the margin thus formed is computed such that a predetermined percentage of a predetermined margin width is defined with respect to dimensions of an original image. Conversely, the margin earlier-mentioned is different from the margin which has been formed intentionally in that the former is not interrelated with dimensions or recorded area of the image. Therefore, the resultant image is not proportional to the margin.

SUMMARY OF THE INVENTION

In view of the aforementioned, it is an object of the invention to obtain an image recording apparatus which is able to prevent margin from being formed and to improve the appearance of the resultant image when a document image is recorded on the overall surface of the recording area of an image recording material.

Further, it is a further object of the invention to obtain an image recording apparatus which assures that a predetermined width of the margin is provided within the recording area of the image recording material, when the document image is an image with margin.

A first aspect of the present invention is an image recording apparatus in which a document image is exposed to a photosensitive material to obtain a reproduced image, comprising: first magnification setting means which automatically sets a first exposure magnification so as to record said document image on the overall surface of the photosensitive material; second magnification setting means which causes the first exposure magnification which has been set by said first magnification setting means to be increased by a predetermined value to set a second exposure magnification in order to prevent margin from being formed at the periphery of the image recorded on said photosensitive material; and exposure means which exposes the document image in the exposure magnification which has been set by one of said first magnification setting means and said second magnification setting means on the basis of the central portion of the document image.

According to the first aspect of the present invention, the first exposure magnification in which the document image is recorded on the overall surface of the photosensitive material is automatically set by the first magnification setting means. Further, in the setting of the first exposure magnification, the exposure magnification is set so that the document image and the photosensitive material are the same in their nominal sizes (for example, a 100% exposure magnification is set from size L of the document size to size L of the photosensitive material, a 108% exposure magnification is set from size E of the document size to size L of the photosensitive material or the like as shown in Table 1). However, in a case of the nominal size described above, margin might be formed at an overall periphery or a portion of the periphery of an exposed or recorded image due to slight variations that occur as a matter of course among different machines of the same make and model, positioning errors of lens in the apparatus or the like. Therefore, the exposure magnification can be changed, by the second magnification setting means, to the second exposure magnification where the first exposure magnification which has been set by the first magnification setting means is increased by the predetermined value so as to prevent margin from being formed at the periphery of the image which is recorded on the photosensitive material.

By performing the exposure based on the second exposure magnification which has been set by the second magnification setting means, an image having a size which is slightly larger than the desired size may be formed on the photosensitive material.

In this way, no margin is formed in the vicinity of the periphery of the photosensitive material. Moreover, even if the image is slightly inclined when it is recorded, the inclination cannot be distinguished.

A second aspect of the present invention is an image recording apparatus which exposes a document image to a photosensitive material to obtain a reproduced image, comprising: image without margin mode setting means which sets an image without margin mode where no margin is formed at the periphery of the image which is exposed to said photosensitive material when said document image is recorded on said photosensitive material; magnification setting means for automatically setting a first exposure magnification where said document image is recorded on the overall surface of the photosensitive material when said image without margin mode has not been set by said image without margin mode setting means, and for changing said first exposure magnification to a second exposure magnification in which said first exposure magnification which has been set is increased by a predetermined value when the image without margin mode has been set; and exposure means which exposes the document image in the exposure magnification which has been set by said magnification setting means based on the central portion of said document image.

According to the second aspect of the present invention, when the document image is recorded on the photosensitive material, it is selected whether or not the image without margin mode which provides no margin at the periphery of the image on said photosensitive material is set. In this selection, when the image without margin mode is not selected, the exposure magnification which has been specified by an operator is set, as it is, as an exposure magnification for scanning and exposing the document or original image. On the other hand, when the image without margin mode is selected and set, a predetermined enlarged magnification is set with respect to the specified exposure magnification as an exposure magnification for scanning and exposing the document or original image.

In this way, the exposure magnification is increased when the image without margin mode is selected. In a case in which the appearance of the recorded image may become worse when margin (border) is formed at the periphery of the image which is exposed to the photosensitive material, the appearance of the image become worse, selecting the image without margin mode prevents irregular margins from being formed at the periphery of the recorded image.

According to a third aspect of the present invention, there is provided an image recording method which exposes a document image to a photosensitive material to obtain a reproduced image, comprising the steps of:

(a) setting one magnification of a first exposure magnification which records said document image to the overall surface of the photosensitive material and a second exposure magnification in which said first exposure magnification has been increased by a predetermined value so as not to provide any margin at the periphery of the image which is recorded on the photosensitive material; and (b) exposing said document image in the exposure magnification which has been set by said step (a) on the basis of the central portion of said document image.

According to a forth aspect of the present invention, there is provided an image recording method which exposes a document image to a photosensitive material to obtain a reproduced image, comprising the steps of:

(a) changing a first exposure magnification where said document image is recorded on the overall surface of said photosensitive material to a second exposure magnification in which said first exposure magnification has been increased by a predetermined value when an image without margin mode is set to prevent the margin from being formed at the periphery of the image which is exposed to said photosensitive material; and (b) exposing said document image to said photosensitive material in said second exposure magnification on the basis of the central portion of said document image.

A heat-developable photosensitive material is known as the photosensitive material which is used for the image recording apparatus in accordance with the above-described aspects. The heat-developable photosensitive material is image wisely exposed so that a latent image is formed thereon. The latent image is heat-developed and transferred to the image receiving material under the presence of an image forming solvent so as to obtain a visible image.

In principle, the heat-developable photosensitive material includes, on a substrate, a photosensitive silver halide, a reducing agent, a binder, and a dye providing compound (there are also cases in which the reducing agent is used in place of this compound) on a supporting body. Incidentally, if desired, the heat-developable photosensitive material can contain an organometallic salt-base oxidizing agent or the like.

The heat-developable photosensitive material may be a material which provides a negative image or a positive image due to the exposure. A method utilizing a direct positive emulsion as the silver halide emulsion (there are two types of this method: a method using a nucleus forming agent and a light fogging method), or a method utilizing dye providing compound which releases a dye image which is diffusible positively can be used as a method of providing a positive image.

The photosensitive material disclosed in, for example, JP-A (Japanese Patent Application Laid-Open) No. 6-161070 and JP-A No. 6-289555 can be used as the heat-developable photosensitive materials of the method of providing a positive image. The photosensitive material disclosed in, for example, JP-A No. 5-181246 and No.

6-242546 can be used as the heat-developable photosensitive materials of the method of providing a negative image.

Water, for example, may be used as the image forming solvent of the present invention. However, the water used in the present invention is not limited to so-called demineralized but is equivalent to the water that has ever been used universally and customarily. Alternatively, the mixed solvent of demineralized water and a low boiling point solvent such as methanol, DMF, acetone, di-isobutyl ketone can be used. In addition, a mixed solvent of an image forming promotor, antifoggants, development inhibitor, and an aqueous heat solvents, or the like may be used.

DESCRIPTION OF THE EMBODIMENT

Figure 1:
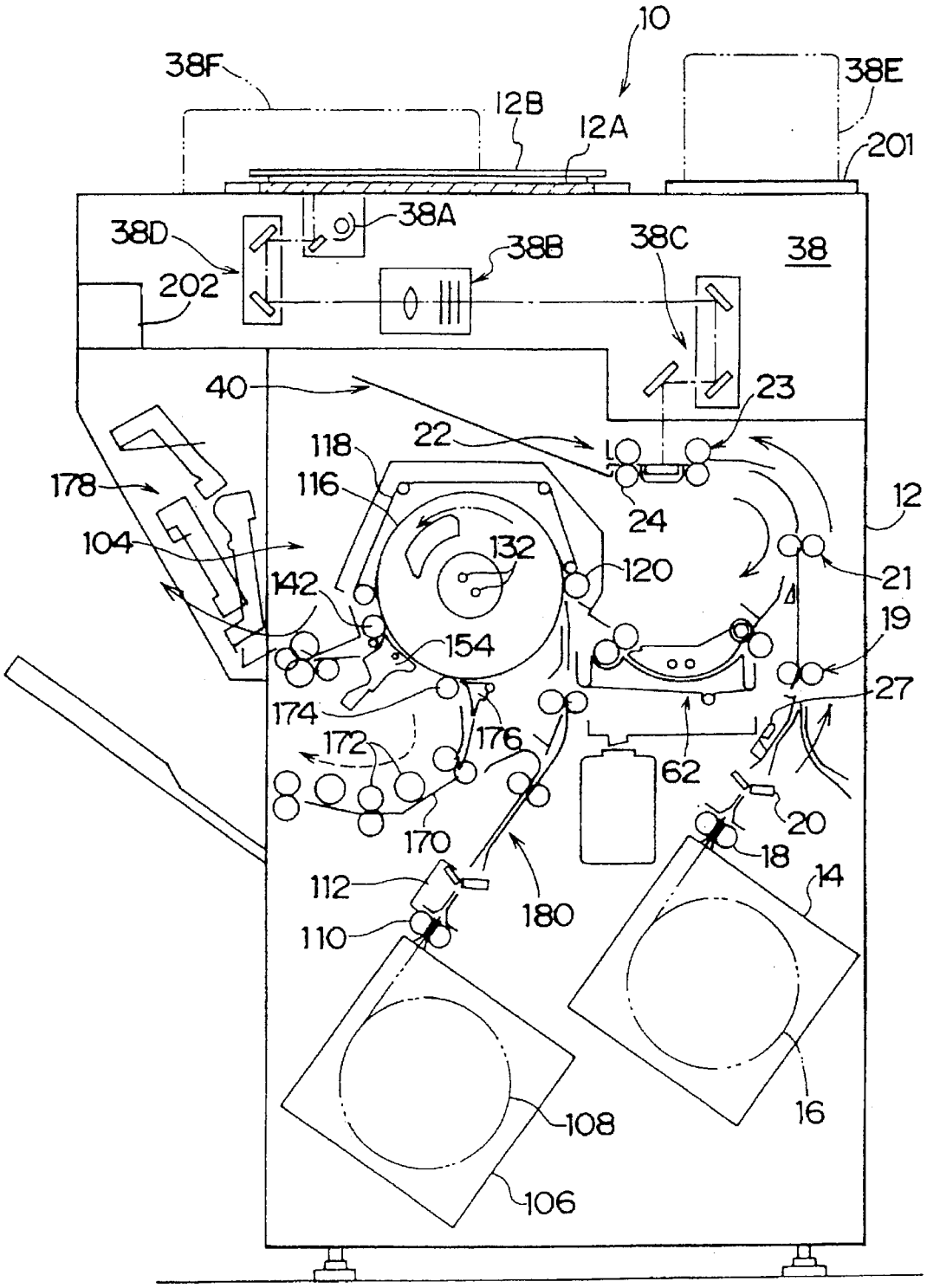
FIG. 1 is an overall schematic diagram of an image recording apparatus according to the present invention.

FIG. 1 shows an overall schematic diagram of an image recording apparatus 10.

Figure 2:
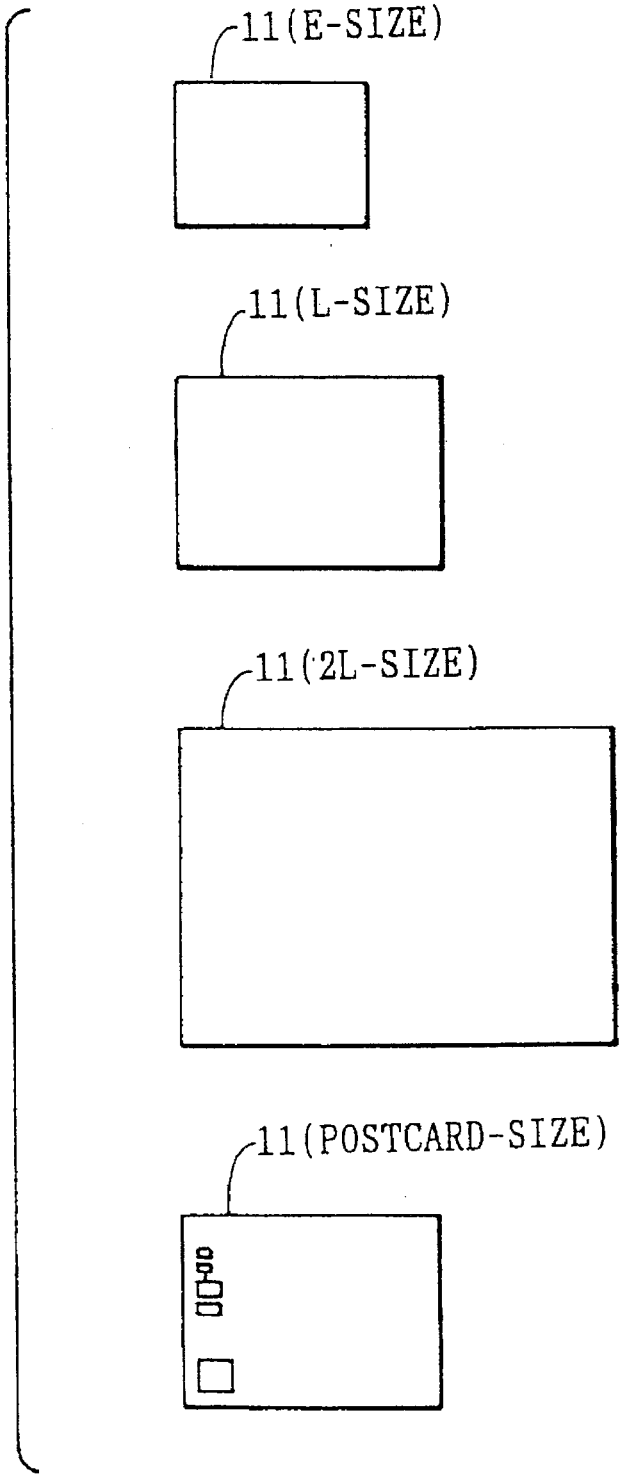
FIG. 2 is a plan view of various document sizes.

On the upper surface of a machine frame 12 of the image recording apparatus 10, a stand 12A on which a document is placed includes a transparent glass plate is provided for placing a document 11 (see FIG. 2) thereon. A cover body 12B which can open and close is mounted to the stand 12A. A reflecting or opaque document is also placed on the stand 12A. A film scanner 38E and a proof-unit 38F are able to be mounted in the vicinity of the stand 12A when an opaque document such as a 35 mm-film (e.g., negative or positive), 4×5-film or the like is applied as an image to be recorded.

As shown in FIG. 1, a photosensitive material magazine 14 is disposed in the machine frame 12 of the image recording apparatus 10 in a state in which the magazine 14 is inclined at a predetermined angle, and it accommodates a photosensitive material 16 in the form of a roll. The photosensitive material 16 is taken up with its photosensitive (exposure) surface facing the lower right side of the image recording apparatus 10 immediately after the photosensitive material 16 has been pulled out from the photosensitive material magazine 14.

A pair of nip rollers 18 and a cutter 20 are disposed in the vicinity of a photosensitive material pick-out port of the photosensitive material 16 in the photosensitive material magazine 14. The nip rollers 18 pull out the photosensitive material 16 from the photosensitive material magazine 14 and the cutter 20 cuts the material 16 to a predetermined length of the photosensitive material 16.

A plurality of transport rollers 19, 21, 23 and 24 and a guide plate 27 are disposed downstream of the cutter 20 along a transport passage, so that the photosensitive material 16 which has been cut to a predetermined length can be transported to an exposure section 22.

The exposure section 22 is located between the transport rollers 23 and the transport rollers 24 so as to form an exposure portion (i.e., exposure point) which is located between the transport roller pairs 23, 24 and through which the photosensitive material 16 passes.

An exposure device 38 is disposed in a space above the exposure section 22 in the image recording apparatus 10. The exposure device 38 is provided with a halogen lamp unit 38A, a lens unit 38B, mirror units 38C, 38D and filter and diaphragm which are not shown. As described above, a film scanner 38E for a transparent document such as 35 mm size-film or the like and a proof unit 38F for an opaque document such as 4×5 size-film or the like can be mounted to the exposure device 38.

Figure 3:
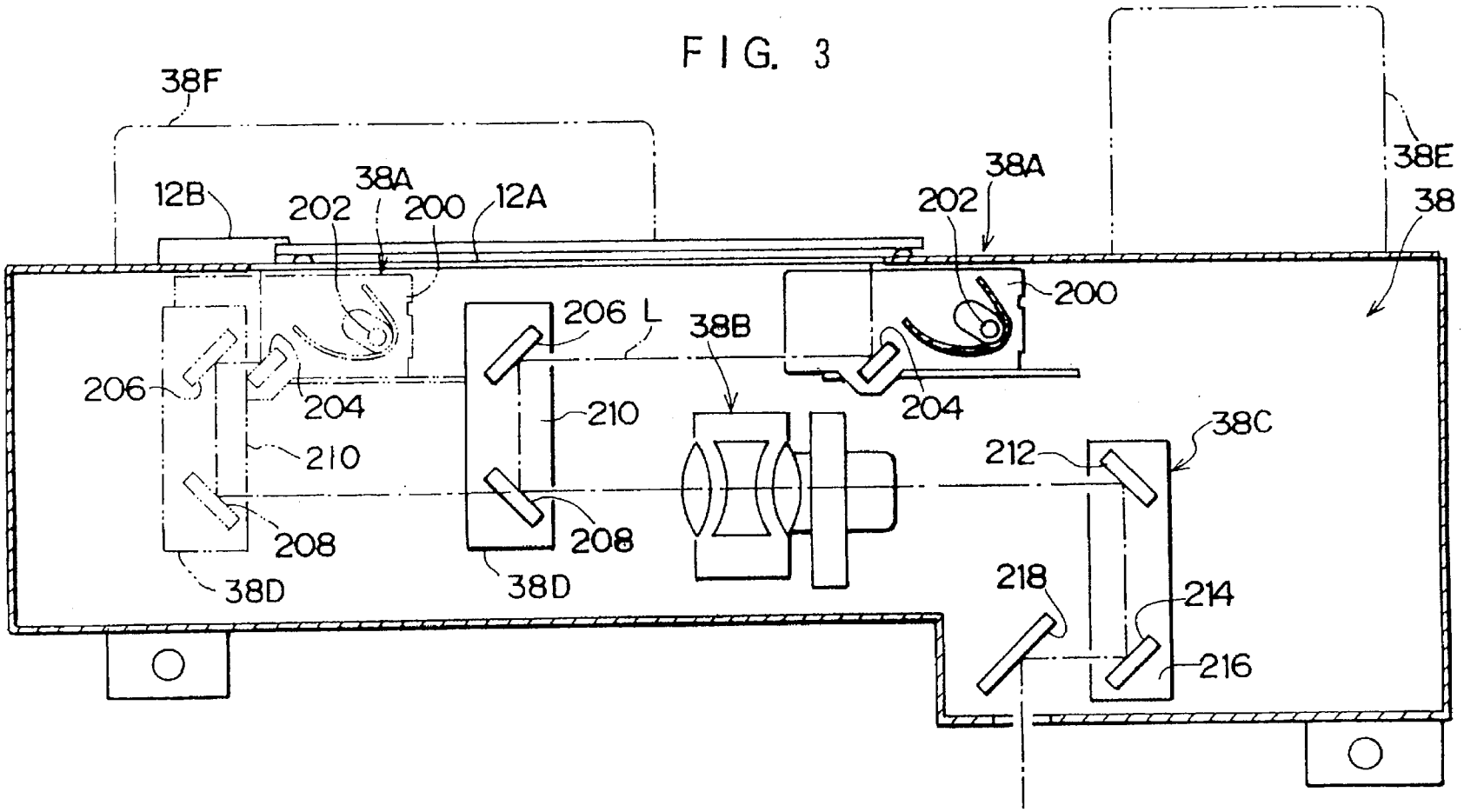
FIG. 3 is an enlarged view of an exposure device which is placed on an upper portion of the image recording apparatus in FIG. 1.

FIG. 3 is a side view showing a state in which each of unit operates in the exposure device 38.

The halogen lamp unit 38A is located below the stand 12A. In the halogen lamp unit 38A, a halogen lamp 202 is mounted to a bracket 200 so that the irradiated light reaches to the stand 12A. Namely, the light of the halogen lamp 202 is irradiated to and reflected from the document which is placed on the stand 12A.

The reflected light is incident upon a first mirror 204 attached to the bracket 200. The halogen lamp unit 38A at its standby position is supposed to receiving the reflected light from the reverse surface of a guide scale 12B located at the left end portion of the stand 12A.

Further, due to the driving force generated by a motor which is not illustrated, the halogen lamp unit 38A is moved along the stand 12A from the standby position (i.e., the position illustrated by a phantom line in FIG. 3) to the right side in FIG. 3 and reached to the right end portion of the stand 12A. This position (i.e., the position illustrated by a solid line in FIG. 3) is referred to a scanning start position. The light which is reflected by the document when the halogen lamp unit 38A moves from the scanning start position toward the left side of the stand 12A is incident upon the first mirror 204.

The first mirror 204 is mounted to the bracket 200 in a state in which the mirror is inclined by 45° with respect to the machine frame 12. Accordingly, an optical axis L of the light vertically incident upon the first mirror 204 is deflected 90° and forms a horizontal optical axis toward the left side of the exposure device 38.

The aforementioned mirror unit 38D is disposed at a portion on the horizontal optical axis L. The mirror unit 38D is provided with two mirrors (i.e., a second mirror 206 and a third mirror 208) fixed to a bracket 210. The second mirror 206 and the third mirror 208 are positioned respectively at the upper and the lower portions of the mirror unit 38D. Further, one mirror is inclined by 45° in one direction and the other is inclined by 45° in the opposite direction with respect to horizontal lines.

Therefore, the second mirror 206 receives and reflects the light from the first mirror 204, so that the light reflected is deflected so as to have a vertical optical axis L. The light having the vertical optical axis L is incident upon the third mirror 208. The surface of the third mirror 208 again deflects the vertical optical axis L to the horizontal optical axis L. The light having the horizontal optical axis L is guided into the mirror unit 38C which is disposed at the right side of the exposure device 38.

Further, the movement of the mirror unit 38D is effected in synchronous with the halogen lamp unit 38A so that the mirror unit 38D and the halogen lamp unit 38A move in the same direction and in parallel with each other.

The amount of the movement of the mirror unit 38D is a half of that of the halogen lamp unit 88A. For example, when the halogen lamp unit 38A moves by 208 mm in the right direction of the device, the mirror unit 38D also moves by 104 mm in the same direction as the halogen lamp unit 88A.

The mirror unit 38C which receives the light reflected by the third mirror 208 is located at the right side of the exposure device 38 and is provided with two mirrors (i.e., a fourth mirror 212 and a fifth mirror 214) fixed to a bracket 216. The fourth mirror 212 and the fifth mirror 214 are relatively positioned at the upper portion and the lower portion in the mirror unit 38C so that each mirror is inclined by 45° with respect to horizontal lines, one mirror being inclined by 45° in one direction and the other being inclined by 45° in the opposite direction. The light reflected from the third mirror 208 is incident upon the fourth mirror 212 placed at the upper portion of the mirror unit 38C so as to deflect the horizontal optical axis L to the vertical one. Moreover, the light which is reflected from the fourth mirror 212 is converted into the horizontal optical axis L by the fifth mirror 214. The light having the horizontal optical axis L is reflected by a fixed mirror 218. The fixed mirror 218 is mounted at the upper portion of the exposure section 22 and inclined by 45° with respect to the horizontal line. Accordingly, the horizontal optical axis L is deflected to the vertical optical axis L and reached to the exposure section 22.

Here, a lens unit 38B is interposed on an optical path between the third mirror 208 in the mirror unit 38D and the fourth mirror 212 in the mirror unit 38C. The lens unit 38B can be moved along the optical axis L, so that the magnification of a reproduced image with respect to a document image can be changed. In association with the change of the magnification, the mirror unit 38C can be moved in parallel to the horizontal optical axis L for implementing the correspondence of the focal length by adjusting the optical path length.

Figure 4:
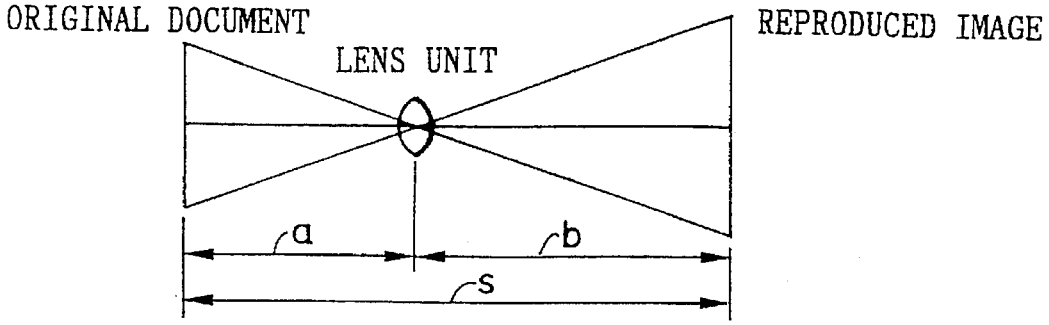
FIG. 4 is a schematic view of a standard model of an optical system.

FIG. 4 shows an optical system in which the relation between a magnification and a focal length is simplified. The change of a magnification in the image recording apparatus 10 of the present embodiment takes a method in which the change of the magnification along the scanning direction of a document (i.e., moving direction of the halogen lamp unit 38A) is different from the magnification along the transverse direction of a document. The change of the magnification along the transverse direction is effected by using a simple optical method. On the other hand, the change of the magnification along the scanning direction is effected by changing the scanning rate and using the simple optical method.

The description of the optical method will be given hereinafter and the following equation may be written:

$$(1/a)+(1/b)=1f$$

where the focal length of the lens unit 38B is f, the length between a document and the lens unit 38B is a, and the length between the lens unit 38B and a reproduced image is b. When the document 11 is placed closer to the lens unit 38B for changing the modification, the value of a becomes small. Therefore, the difference between the original value of a and the value of a which has become small as described above must be added to the value of b.

FIG. 3 shows the case in which the lens unit 38B is moved along the optical axis L in the desired magnification while the mirror unit 38C is moved to the opposite direction of the movement of the lens unit 38B.

As described above, the magnification is set and the document is scanned. Simultaneously, at the exposure section 22, the photosensitive material 10 is transported at a constant rate so as to expose a document image thereto.

As shown in FIG. 1, a switch back section 40 is provided adjacent to the exposure section 22, and a water application section 62 is provided below the exposure section 22. The photosensitive material 16, which has been transported in such a manner as to rise upwardly along the transport passage from the photosensitive material magazine 14 and has been exposed at the exposure section 22, is temporarily fed into the switch back section 40, and is then fed into the water application section 62 through the exposure section 22 as the transport roller pairs 24, 23, and 21 are rotated reversely.

A plurality of pipes (not shown) are connected to the water application section 62 to supply water to the water application section 62.

A heat development/transfer section 104 is disposed adjacent to the water application section 62, into which the photosensitive material 16 applied with water is fed.

Meanwhile, an image-receiving-material magazine 106 is disposed on the left side of the photosensitive material magazine 14 in the machine frame 12 in FIG. 1, and an image receiving material 108 is accommodated therein in the form of a roll. A dye fixing material having a mordant has been applied to the image-forming surface of the image receiving material 108. When the image-receiving-material magazine 106 has been pulled out from the image receiving material 108, the image-forming surface of the image receiving-material 106 faces to the lower right side of the image recording apparatus.

A pair of nip rollers 110 is disposed in the vicinity of an image-receiving-material picking-up port of the image-receiving-material magazine 106 and is able to pull out the image receiving material 108 from the image-receiving-material material magazine 106. The nip roller pair 110 can be released. A cutter 112 is placed adjacent to the nip roller pair 110.

An image-receiving-material transport portion 180 is provided next to the cutter 112 near the photosensitive material magazine 14 so as to transport the image receiving material 108 cut to a predetermined length to the heat development/transfer section 104.

The photosensitive material 16 which is transported to the heat development/transfer section 104 is fed into a nip between a superposing roller 120 and a heating drum 116. Further, the image receiving material 108 is also fed into the nip between the superposing roller 120 and the heating drum 116 in synchronous with the transport of the photosensitive material 16 in a state in which the image receiving material 108 is preceded by the photosensitive material 16 by a predetermined length, and the image receiving material 108 and the photosensitive material 16 are superposed together.

A pair of halogen lamps 132 is disposed within the heating drum 116 and is able to raise the temperature on the surface of the heating drum 116.

An endless pressure-contact belt 118 is entrained around four entraining rollers substantially over a semicircle of the heating drum 116. The entraining portion is brought into a state in which the endless pressure-contact belt 118 is pressed to and made contact the heating drum 116 by a predetermined force.

A bending/guiding roller 142 is disposed downstream of the endless pressure-contact belt 118 in the transporting direction of the materials and on the lower side of the heating drum 116. A peeling claw 154 is disposed downstream of the bending/guiding roller 142 in the transporting direction of the materials and on the lower side of the heating drum 116, and is rotatably supported by a shaft.

The photosensitive material 16 which has been peeled by the peeling claw 154 is entrained around the bending/guiding roller 142 and is accumulated in a waste photosensitive material accommodating box 178.

A peeling roller 174 and a peeling claw 176 are disposed in the vicinity of the heating drum 116 on the side of the bending/guiding roller 142. Disposed below the peeling roller 174 and the peeling claw 176 are an image receiving material guide 170 as well as a pair of image-receiving-material discharge rollers 172, so that the image receiving material 108 peeled off from the heat drum 116 can be guided and transported by the peeling roller 174 and the peeling claw 176.

The image receiving material 108 which has been peeled off from the outer periphery of the heating drum 116 by the peeling claw 176 is transported by the image-receiving-material guide 170 and the image-receiving-material discharge rollers 172 and is discharged to a tray and which projects from the machine frame 12.

Meanwhile, during the scanning and the exposure in the present embodiment, when a specified photo size is selected as the document 11, the document image is able to be exposed in a predetermined magnification based on the central portion of a document or original image.

Namely, if a document size is known, the central position of the document image can be recognized by computing the value thereof. The exposable length or distance in the scanning direction of the document image is determined by an exposure magnification. Accordingly, the determined length is separated into the right portion and left portion of the image from the central position thereof, so that the right end portion and the left end portion of the document image can be determined. A reproduced image based on the central portion of the document image can be obtained by scanning and exposing the document image within a determined range of the exposable length.

Further, when the document image is recorded on the entire recording surface of the photosensitive material 16, for example, when the document image is exposed to the photosensitive material 16 in an equal magnification, a magnification becomes 100% as might be expected in a case in which the document image and the photosensitive material 16 have the same dimensions. However, margin might be formed on the photosensitive material 16 at the periphery of the recorded image depending on the accuracy of the widthwise and longitudinal sizes of the photosensitive material 16, the accuracy of the magnification setting by moving the lens unit 38B, or the like.

Accordingly, the document image is exposed to the photosensitive material 16 in a slightly larger magnification than the specified one in which the document image has been exposed based on the aforementioned central portion of the document image. In Table 1, the change of the magnification is defined as follows:

TABLE 1

| regular magnification | Output Size of a Photosensitive Material | | | | | |
|---|---|---|---|---|---|---|
| | L (89 × 127 mm) | | 2 L (127 × 178 mm) | | Postcard (102 × 148 mm) | |
| table document size | without margin | with margin | without margin | with margin | without margin | with margin |
| E(82.5 × 117 mm) | 113% | 108% | 159% | 153% | 130% | 124% |
| L(89 × 127 mm) | 105% | 100% | 148% | 141% | 120% | 115% |
| 2L(127 × 178 mm) | 74% | 71% | 104% | 100% | 86% | 81% |

As described in Table 1, in a case of "an image without margin", a magnification (e.g., 104%) which is slightly larger than a regular magnification (e.g., 100%) is set. Further, in a case of "an image with margin" in Table 1, the regular magnification refers to the magnification in which the document image is recorded on the overall surface of the photosensitive material 16 corresponding to the document size. Otherwise, when the magnification is set manually, the above-described setting method is neglected, so that the scanning and the exposure can be implemented in the specified magnification. In addition, "an image with margin" in Table 1shows that when the document image has a margin (border), the document image including margin is exposed to the overall surface of the photosensitive material 16 as it is. Moreover, the setting of the image without margin can be performed by operating the key on an operational display panel 200 (i.e., image without margin mode setting means).

Further, the image recording apparatus 10 has a control device 202 which controls respective members, respective portions and apparatuses or the like such as an exposure device or the like, as described above. The control device 202 also controls respective members, respective portions, and an apparatus or the like within the image recording apparatus 10, so that the image recording apparatus 10 is set to the mode which has been set or changed due to a mode setting or a mode changing by operating the keyboard on the operational display panel 201. Further, the control device 202 has a function capable of computing the value of the central portion of a document (i.e., a document image) based on the size of the document to be recorded.

Next, a description will be given of the operation of the present embodiment. First of all, in a case that a reflecting document is reproduced, after predetermined settings (of the magnification, the number of sheets, or the like) have been completed, the following image recording process is started by operating the starting key.

Namely, the nip rollers 18 are actuated in a state in which the photosensitive material magazine 14 is loaded into the apparatus 10. When the photosensitive material 16 is pulled out from the photosensitive material magazine 14 by a predetermined length, the cutter 20 is actuated and cuts the photosensitive material 16 pulled out to a predetermined length.

After the cutter 20 has been actuated, the photosensitive material 16 is transported to the exposure section 22 with its photosensitive (exposure) surface facing upward of the image recording apparatus 10. The exposure device 38 is operated in synchronous with the transport of the photosensitive material 16 at the exposure section 22 so as to scan and expose the document image to the photosensitive material 16 during the movement thereof at the exposure section 22.

During the exposure process, the photosensitive material 16 is fed to the switch back section 40 such that the photosensitive material 16 to which the document image has already been exposed is fed into the water application section 62 as the transport roller pairs 24, 23, and 21 rotates reversely.

At the water application section 62, water is applied to the photosensitive material 16 which in turn is fed into the heat development/transfer section 104.

Meanwhile, as the scanning of the document image and the exposure thereof to the photosensitive material 16 are started, the image receiving material 108 is taken up from the image receiving material magazine 106 by the nip rollers 110 and transported. When a predetermined length of the image receiving material 108 is taken up, the cutter 112 is actuated and cuts the image receiving material 108 to a predetermined length.

After the cutter 112 has been actuated, the image receiving material 108 is caused to be in a standby state directly in front of the heat development/transfer section 104 while the image receiving material 108 is guided by the image receiving material transport portion 180.

In the heat development/transfer section 104, by detecting that the photosensitive material 16 has been fed into a nip between the periphery of the heating drum 116 and the superposing roller 120, the transport of the image receiving material 108 is restarted. The image receiving material 108 is also fed into the superposing roller 120 and the heating drum 116 is actuated.

The photosensitive material 16 and the image receiving material 108 are superposed by the superposing roller 120. The photosensitive material 16 and the image receiving material 108 are nipped between the heating drum 116 and the endless pressure-contact belt 118 in a state in which the photosensitive material 16 and the image receiving material 108 are superposed together and transported substantially around half of the peripheral surface of the heating drum 116. Therefore, the photosensitive material 16 and the image receiving material 108 are heated by the heating drum 116 so that the photosensitive material 16 discharges movable dyes, while the discharged dyes are transferred to a dye fixing layer of the image receiving material 108 and are able to obtain a reproduced image on the image receiving material 18.

Thereafter, when the photosensitive material 16 and the image receiving material 108 which have been nipped and conveyed reaches at a portion under the heating drum 116, the peeling claw 154 is actuated to engage with the tip end portion of the photosensitive material 16 which is preceded a predetermined length by the image receiving material 108, so that the tip portion of the photosensitive material 16 can be peeled off from the outer periphery of the heating drum 116.

Further, the photosensitive material 16 is entrained around the bending/guiding roller 142 and is guided to and accumulated in the waste photosensitive material accommodating box 178.

Meanwhile, the image receiving material 108 which has been separated from the photosensitive material 16 and transported in a state in which the image receiving material 108 is tightly in contact with the heating drum 116 1s conveyed to the peeling roller 174 and is thereby peeled off from the outer periphery of the heating drum 116.

While the image receiving material 108 which has been peeled off from the outer periphery of the heating drum 116 by the peeling claw 176 is being wound around the peeling roller 174, it is thereby moved to the lower side of the heating drum 116. While the image receiving material 108 is being guided by the image-receiving-material guide 170, it is transported by the image-receiving-material discharge rollers 172 and is discharged to a tray.

In accordance with the present embodiment, different magnifications (see Table 1) are set depending on whether an image without margin mode is set or not, when an image is recorded on (i.e., transferred to) the overall surface of the image receiving material 108 based on the image recording process in a regular magnification, that is, a document size and an output size.

When the image without margin mode is not set, the image recording process is effected based on a nominal regular magnification. For example, in a case in which the document size and the output image (i.e., the image exposed to the photosensitive material) are the same size, a 100% magnification is set as a nominal magnification, and an actual exposure process is also effected in a 100% magnification. Therefore, in a case in which a document image is an image with margin, it is certain that the image is recorded such that a predetermined margin is provided on the photosensitive material 16.

Figure 5A:
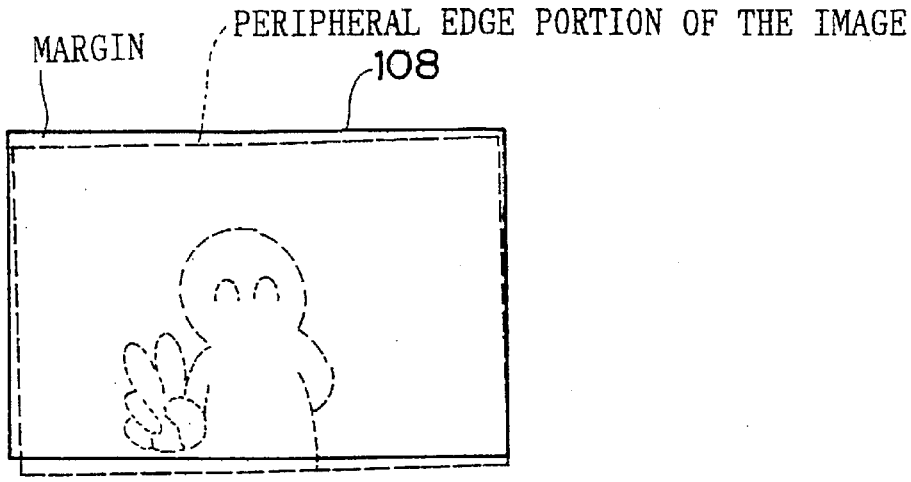
FIG. 5A is a plan view illustrating positions of a recorded image and an image recording material picture pattern which is provided in such a manner that an original document is scanned on the basis of the center of the document and recorded on the image recording material in a nominal regular magnification.

On the other hand, when an image is recorded on the photosensitive material 16 in a 100% magnification, the image can be recorded on the overall surface of the photosensitive material 16 without forming any margin, unless there is any error in positioning accuracy of setting the magnification by the lens unit 38B, the positioning accuracy of the photosensitive material 16 in the thickness direction thereof at the exposure section 22, and the size accuracy of the photosensitive material 16. However, in a case in which there might be some error in the above-described accuracies (including a tolerance), margin may be formed at the periphery of the image recording area, and the margin width becomes irregular, so that the appearance of the image becomes worse (see FIG. 5A). Therefore, in the present embodiment, in order to make sure that margin is prevented from being formed at the periphery of the image recording area, a predetermined enlarged magnification is set with respect to the nominal magnification in a regular magnification, so that the image recording process is implemented in this enlarged magnification.

Figure 5B:
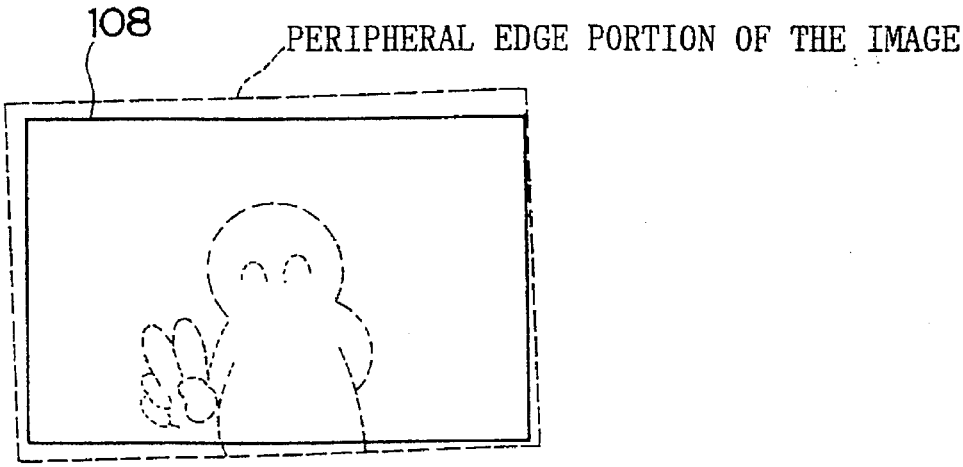
FIG. 5B is a plan view illustrating positions of a recorded image and an image recording material picture pattern which is provided in such a manner that an original document is scanned on the basis of the center of the document and recorded on the image recording material in a predetermined enlarged magnification with respect to the nominal regular magnification.

Accordingly, because the peripheral edge of the image exposed to the photosensitive material and transferred to the image receiving material is positioned outside of the peripheral edges of the photosensitive material 16 and the image receiving material 18, the appearance of the margin can be prevented. Further, even if the image is substantially inclined, the inclination thereof cannot be easily distinguished. As a result, it is possible to improve the appearance of the recorded image (see FIG. 5B).

What is claimed is:

1. An image recording apparatus which exposes a document image to a photosensitive material to obtain a reproduced image, comprising:

first magnification setting means which automatically sets a first exposure magnification in which said document image is recorded on the overall surface of said photosensitive material;

second magnification setting means which changes said first exposure magnification which has been set by said first magnification setting means to set a second exposure magnification where said first exposure magnification has been increased by a predetermined value so that margin is prevented from being formed at the periphery of an image which is recorded on said photosensitive material; and exposure means which exposes said document image to said photosensitive material, on the basis of the central portion of said document image, in one of said first exposure magnification which has been set by said first magnification setting means and said second exposure magnification which has been set by said second magnification setting means.

2. An image recording apparatus according to claim 1, further comprising transfer means which transfers the image which has been exposed to said photosensitive material to an image receiving material.

3. An image recording apparatus according to claim 2 wherein said transfer means is heat development/transfer means which tightly contacts said photosensitive material and said image receiving material to each other, heat-develops the image on said photosensitive material, and transfers the heat-developed image to said image receiving material.

4. An image recording apparatus according to claim 1 wherein said second magnification setting means sets said second exposure magnification such that the exposing area is larger than the size of said photosensitive material.

5. An image recording apparatus according to claim 1, further comprising magnification changing means which changes the exposure magnification of said document image to said photosensitive material.

6. An image recording apparatus according to claim 5 wherein:

said document image has a substantially rectangular shape;

said exposure means is provided for scanning said document image along the longitudinal direction thereof and for exposing said document image to said photosensitive material; and said magnification changing means is provided for optically changing the exposure magnification in the direction orthogonal to the direction in which said document image is scanned and for changing the exposure magnification in the direction in which said document image is scanned by changing optically and by changing the scanning rate for said document image.

7. An image recording apparatus according to claim 1, further comprising a control device which computes the value of the central portion of said document image based on the size of said document image.

8. An image recording apparatus which exposes a document image to a photosensitive material to obtain a reproduced image, comprising:

image without margin mode setting means which sets the image without margin mode where no margin is formed at the periphery of the image which is exposed to said photosensitive material when said document image is recorded on said photosensitive material;

magnification setting means for automatically setting a first exposure magnification in which said document image is recorded on the overall surface of said photosensitive material when said image without margin mode has not been set by said image without margin mode setting means, and for changing said first exposure magnification to a second exposure magnification in which said first exposure magnification which has been set is increased by a predetermined value when the image without margin mode has been set;

and exposure means which exposes the document image in the exposure magnification which has been set by said magnification setting means based on the central portion of said document image.

9. An image recording apparatus according to claim 8, further comprising transfer means which transfers the image which has been exposed to said photosensitive material to an image receiving material.

10. An image recording apparatus according to claim 9 wherein said transfer means is heat development/transfer means which tightly contacts said photosensitive material and said image receiving material to each other, heat-develops the image on said photosensitive material, and transfers the heat-developed image to said image receiving material.

11. An image recording apparatus according to claim 8 wherein said second magnification setting means sets said second exposure magnification such that the exposing area becomes larger than the size of said photosensitive material.

12. An image recording apparatus according to claim 8, further comprising magnification changing means which changes the exposure magnification of said document image to said photosensitive material.

13. An image recording apparatus according to claim 12 wherein:

said document image has a substantially rectangular shape;

said exposure means is provided for scanning said document image along the longitudinal direction thereof and for exposing said document image to said photosensitive material; and said magnification changing means is provided for optically changing the exposure magnification in the direction orthogonal to the direction in which said document image is scanned and for changing the exposure magnification in the direction in which said document image is scanned by changing optically and by changing the scanning rate for said document image.

14. An image recording apparatus according to claim 8, further comprising a control device which computes the value of the central portion of said document image based on the size of said document image.

15. An image recording method which exposes a document image to a photosensitive material to obtain a reproduced image, comprising the steps of:

(a) setting one of a first exposure magnification in which said document image is recorded on the overall surface of the photosensitive material, and a second exposure magnification in which said first exposure magnification has been increased by a predetermined value so as not to provide any margin at the periphery of the image which is recorded on the photosensitive material; and (b) exposing said document image in the exposure magnification which has been set in said Step (a) on the basis of the central portion of said document image.

16. An image recording method according to claim 15, further comprising the step of computing a value of the central portion of said document image prior to said Step (b).

17. An image recording method which exposes a document image to a photosensitive material to obtain a reproduced image, comprising the steps of:

(a) changing a first exposure magnification in which said document image is recorded on the overall surface of said photosensitive material to a second exposure magnification in which said first exposure magnification has been increased by a predetermined value when an image without margin mode which prevents margin from being formed at the periphery of the image which has been exposed to said photosensitive material is set; and (b) exposing said document image to said photosensitive material in said second exposure magnification on the basis of the central portion of said document image.

18. An image recording method according to claim 17, further comprising the step of computing the value of the central portion of said document image prior to the Step (b).

* * * * *